United States Patent [19]

Nakanishi et al.

[11] 4,087,668

[45] May 2, 1978

[54] ELECTRICAL CONTACT

[75] Inventors: Ryoichi Nakanishi; Masaru Ito, both of Tokyo, Japan

[73] Assignee: Kabushiki Kaisha Meidensha, Tokyo, Japan

[21] Appl. No.: 649,517

[22] Filed: Jan. 15, 1976

[30]

Foreign Application Priority Data

| | | |
|---|---|---|
| Jan. 29, 1975 | Japan | 50-13251 |
| Feb. 21, 1975 | Japan | 50-24426 |
| May 19, 1975 | Japan | 50-67426 |

[51] Int. Cl.[2] ..... H01H 1/42; H01H 1/50

[52] U.S. Cl. ..... 200/254; 200/255; 200/257; 200/260; 200/283; 200/290

[58] Field of Search ..... 200/254, 255, 257, 260, 200/283, 290

[56] References Cited

U.S. PATENT DOCUMENTS

| | | | |
|---|---|---|---|
| 2,433,115 | 12/1947 | Green | 200/255 |
| 2,462,285 | 2/1949 | Rees | 200/255 |
| 2,668,892 | 2/1954 | Kelle | 200/255 |
| 2,760,034 | 8/1956 | Kowalski et al. | 200/255 |
| 3,052,786 | 9/1962 | Bertling | 200/255 |
| 3,381,105 | 4/1968 | Mortenson | 200/255 |
| 3,382,340 | 5/1968 | Moodie et al. | 200/255 |
| 3,427,419 | 2/1969 | Findley, Jr. | 200/255 |
| 3,588,413 | 6/1971 | Stanback | 200/255 |

*Primary Examiner*—Brooks H. Hunt
*Attorney, Agent, or Firm*—Haseltine, Lake & Waters

[57] ABSTRACT

An electrical contact with a fixed conductor and a movable conductor, comprises a plurality of plate springs, a plurality of contacts, the plate springs and the contacts being mounted into a single unit with an arrangement of those members in a substantial orthogonal relation to each other. The opposite ends of each of the plate springs being supported so as to provide an arrangement of contacts spaced at a fixed interval.

7 Claims, 14 Drawing Figures

ELECTRICAL CONTACT

FIELD OF THE INVENTION

The present invention relates to an electrical contact and, more particularly, to one used in an automatic coupling type disconnector of electrical apparatus such as a disconnector switch, or the like.

PRIOR ART

By convention, the common practice in a switch of this type is to use coil springs as the springs for contact pressure which is used for providing a smooth movement of the movable conductor and applying a given uniform contact pressure of the contact against the conductors. It is for this reason that the path of the contact pressure springs depends largely on the cross-sectional shapes of the opposite conductors, such as circular or rectangular and, thus, the structure of the contact pressure spring must be changed whenever the shape of the conductor's cross section is changed. Such great dependency on the conductor cross section provides an obstruction when the components substantially constituting the electrical contact is made to be standardized for easy and simple manufacture of the electric contact. More specifically, when designing the electrical contact, the shape or structure of the main circuit disconnector must be taken into account and, therefore, it is necessary to preparatively design and fabricate various main circuit disconnectors having different structures. Moreover, the use of coil springs provides several disadvantages in the assembling process. For example, there is a strong possibility that the components which are sub-assembled are broken into pieces during assembly and thus such assembly is troublesome.

SUMMARY OF THE INVENTION

It is accordingly an object of the present invention to provide an electrical contact using plate springs as the springs for contact pressure.

Another object of the present invention is to provide an electrical contact in which a plate spring and a contact are assembled into a unit (hereinafter referred to as a contact segment or a module part in this specification), a plurality of which constitute a contact assembly.

It is a further object of the present invention to provide an improved electrical contact which is easily assembled irrespective of the cross sectional shape of conductors merely by mounting the contact segments, or the module parts, on the supporting members, each being shaped in compliance with the cross sectional shape of the conductors.

Still another object of the present invention is to provide an improved electrical contact whose capacity is easily changed by a suitable selection of the number of the contact segments or the pitch of the contact segments arranged on the supporting members.

Yet another object of the present invention is to provide an improved electrical contact by which the contacts to be pressed against the fixed and movable conductors are prevented from assuming an adverse inclination.

Still a further object of the present invention is to provide an improved electrical contact by which the contacts are properly operated in association with the switching operation of the movable conductor while ensuring a proper contact pressure of the contacts against the associated conductors, even if the fixed and movable conductors are deviated within a permissible extent.

In accordance with the present invention, there is provided a first electrical contact with fixed and movable conductors, comprising at least one plate spring, at least one contact, means for mounting the plate spring and the contact into a single unit with an arrangement of those members in a substantial orthogonal relation to each other, and means for supporting the opposite ends of the plate spring so as to provide an arrangement of contacts spaced at a fixed interval, wherein the movable conductor is movable to be in contact with or away from one of the ends of the contact for switching the electrical contact on or off.

In accordance with the present invention, there is provided a second electrical contact characterized in that the first electrical contact is further provided with means having a grooved cross section mounted shiftably in the radial direction on one end of the fixed conductor, wherein the top ends of the mounting means are placed in the groove.

According to the present invention, there is provided a third electrical contact featured in that the mounting means of the second electrical contact sandwiches the contact with two legs extending beyond the contact one of which straightly extends to be partly placed in the groove while the other of which is so extended and bent as to be in contact with the straight leg of the adjacent contact segment when the contact inclines to a predetermined extent.

The above and other objects and advantages of the present invention may be best understood from the following detailed description of the embodiments of the invention shown in the accompanying drawings, in which:

DESCRIPTION OF THE PREFERRED EMBODIMENTS

Figure 1:
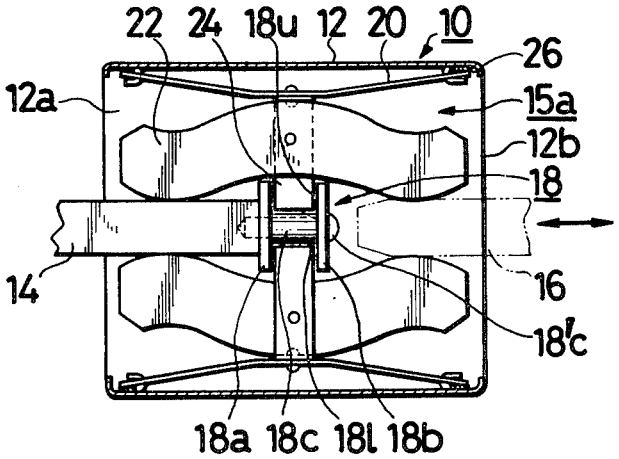
FIG. 1 is a cross sectional view of an embodiment of an electrical contact according to the present invention, FIG. 2 schematically shows a horizontal cross sectional view of the FIG. 1 device illustrating the arrangement of contact segments and the relationship of the contact segments to a stopper.
Figure 2:
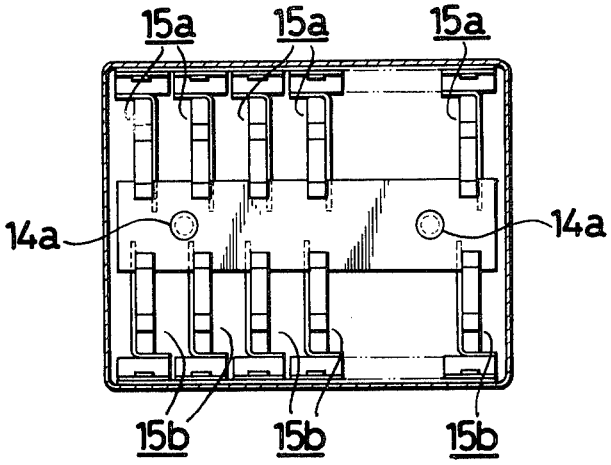

With more particular reference now to the accompanying drawings, like numerals denote like parts and structural features in the various figures. In FIGS. 1 and 2, an electrical contact with rectangular cross section is generally indicated by the reference numeral 10 and schematically illustrated in cross section in FIG. 1 and in longitudinal cross section in FIG. 2. The electrical contact 10 comprises a contact assembly generally indicated by the numeral 15, a housing 12, a fixed conductor 14, a movable conductor 16, and a stopper generally indicated at 18.

Figure 9:
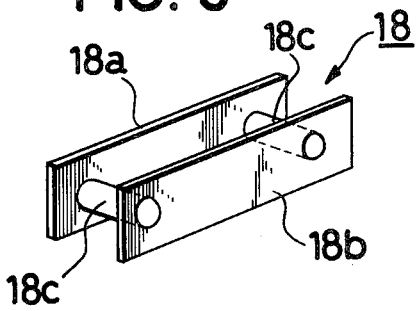
FIG. 9 is a perspective view of a stopper used in the electrical contact embodying the present invention, FIG. 10 schematically shows a horizontal cross sectional view of another embodiment of an electrical contact according to the present invention, FIG. 11 schematically shows in cross sectional form the electrical contact of FIG. 10 for illustrating the arrangement of the contact segments assembled, FIG. 12 schematically shows in horizontal cross sectional form still another embodiment of an electrical contact according to the present invention, FIG. 13 schematically shows a cross sectional view taken along line XIII — XIII in FIG. 12 in which only three contact segments with omission of the remaining contact segments are illustrated for ease of illustration, and, FIG. 14 schematically illustrates in cross sectional form a modification of the FIG. 13 embodiment the electrical contact.

The housing 12 is provided at the respective ends with openings 12*a* and 12*b* each rectangular as shown in FIG. 2. The contact assembly 15 consists of a plurality of the contact segments 15*a* each including a plate spring 20, a contact 22, and an L-shaped supporting member 24, as will be described in detail later. An upper contact assembly consisting of a first series of contact segments 15*a* is rigidly mounted through a supporting member 26 on the inner wall of the upper side of the housing 12. On the other hand, a lower contact assembly consisting of a second series of contact segments 15*a* is rigidly mounted through the supporting member 26 on the inner wall of the lower side of the housing 12. The upper and lower contact assemblies are oppositely arranged in a face-to-face relation, as best shown in FIGS. 1 and 2. The stopper 18 consists of a pair of parallel plates 18*a* and 18*b* with a couple of parallel spacers 18*c*, as best shown in FIG. 9. More particularly, the stopper 18 is actually assembled by screwing respective bolts 18'*c* through the corresponding spacers 18*c* into internal threads 14*a* which are formed on one end of the fixed conductor 14 of a plate-like shape.

Figure 3:
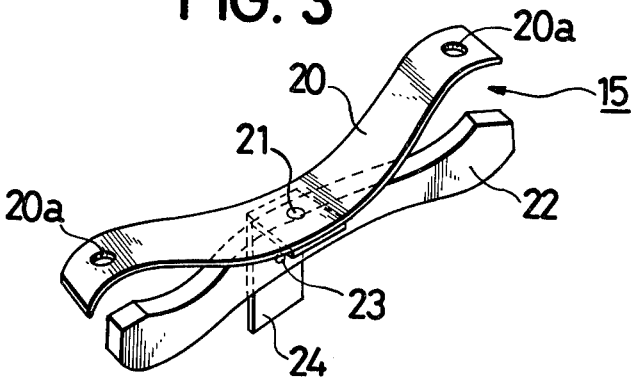
FIG. 3 shows a perspective view of a contact segment used in the electrical contact of the instant invention.
Figure 4:
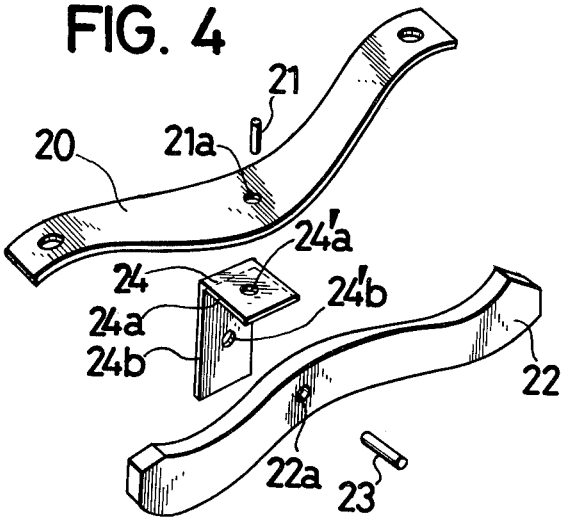
FIG. 4 shows an exploded view of the contact segment of FIG. 3.
Figure 5:
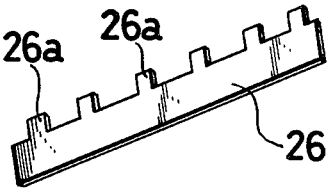
FIG. 5 illustrates a supporting member employed in the electrical contact embodying the instant invention.

Turning now to FIGS. 3 and 4, there is illustrated an example of one of the contact segments 15*a*. As previously mentioned, the contact segment 15*a* is assembled from the plate spring 20, the contact 22 and the L-shaped supporting member 24 by using suitable connecting means such as, for example, rivets, pins, screws or the like. More particularly, the plate spring 20 is curved in the form of a bow in which both the opposite ends thereof are each provided with a hole 20*a* and another hole 21*a* is formed at the top of the arcuate plate spring 20 and substantially at the center thereof. The L-shaped supporting member 24 consists of longer and shorter legs 24*b* and 24*a* having corresponding holes 24'*b* and 24'*a*. The contact 22 also is arcuate but different from the arcuate plate spring 20 in shape in that the former is curved in the thickness direction while the latter is curved in the width direction, as shown in FIGS. 3 and 4. The contact 22 also has a hole 22*a* substantially at the center. In assembling, the plate spring 20 is rigidly mounted at the top on the shorter leg 24*a* of the L-shaped supporting member 24 by means of a rivet 21, for example, fitted into the holes 21*a* and 24'*a* aligned with each other. The contact 22 is rotatably mounted at the center on the inner side of the longer leg 24*b* of the L-shaped supporting member 24 by means of a pin 23 fitted into the aligned holes 24'*b* and 22*a*. However, the contact 22 may also be mounted on the L-shaped member 24 by a rigid connection by using the rivet, for example, as in the case of the plate spring 20 because of a sufficient deformation of the plate spring 20, as will be seen later. In this manner, one contact segment 15*a* is completely assembled.

Figure 6:
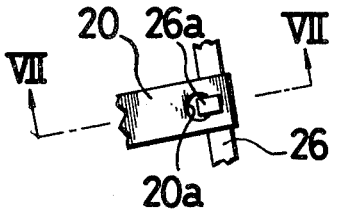
FIGS. 6 and 7 illustrate the loose connection of a plate spring with the supporting member.
Figure 7:
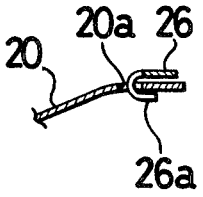

In FIG. 6, there is shown one of the supporting members 26 of a plate shape with a plurality of projections 26*a*. The supporting member 26 is mounted at the respective ends of the arcuate plate spring 20 by inserting the respective projections 26*a* into the corresponding holes 20*a*. More particularly, the projections 26*a* inserted into the holes 20*a* are folded down, individually, for ensuring a connection, preferably a loose but reliable connection therebetween, as shown in FIGS. 6 and 7.

Figure 8:
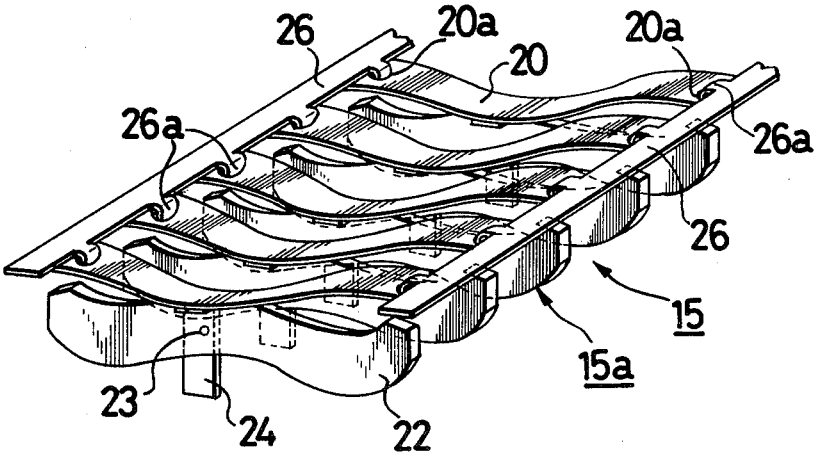
FIG. 8 is a perspective view of a contact assembly assembled from a pair of supporting members and a plurality of contact segments, the assembly being used for electrical contact with a rectangular cross section.

FIG. 8 shows a contact assembly assembled in such a manner. As seen from the figure, five contact segments 15*a* are parallel arranged at a fixed interval with a pair of supporting members 26 each connected with one of the opposite ends of the plate spring 20 in the above-mentioned manner.

A detailed construction of the stopper 18 is illustrated in FIG. 9. As previously stated, the stopper 18 is comprised of a pair of plates 18*a* and 18*b* in parallel spaced relation with a pair of spacers 18*c* each having a bore permitting the bolt 18'*c* to pass therethrough.

Two sets of thus assembled contact assemblies are prepared for assembling the electrical contact of the instant example. One contact assembly is fixed onto the inner wall of the upper side of the housing 12, while another contact assembly is fixed onto the inner wall of the lower side thereof. More specifically, a pair of supporting members 26 of each contact assembly is directly fixed onto the corresponding inner wall by means of suitable means, for example, bolt-nut combinations. In this case, the fixed plate conductor 14 is arranged such that the conductor 14 is held in mechanical contact between the projecting portions facing each other of the upper and lower contacts 22 for providing electrical contact, and the upper space 18*u* between the plates 18*a* and 18*b* receives a part of the lower end portion of the L-shaped member 24 while the lower space receives a part of the upper portion of the L-shaped supporting member 24 for ensuring positioning of the fixed conductor 14. The movable conductor is movable between the upper and the lower contacts of the corresponding contact subassemblies i.e. conductor segments. When the movable contact is slidably inserted between the upper and the lower contacts, electrical contact is established between the fixed conductor 14 and the movable conductor 16, through the contacts of the upper and the lower contact subassemblies. For turning off the electrical contact, the movable conductor 16 is slidably removed from the space between the contacts 22 and 22.

Figure 10:
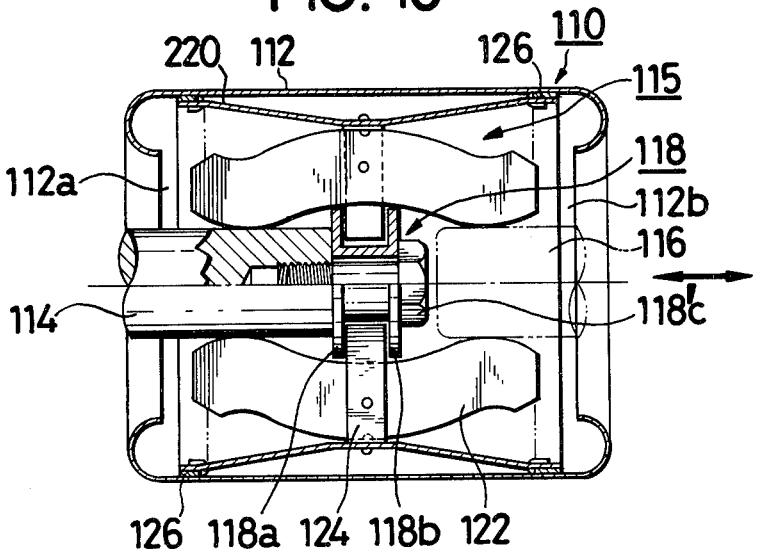
Figure 11:
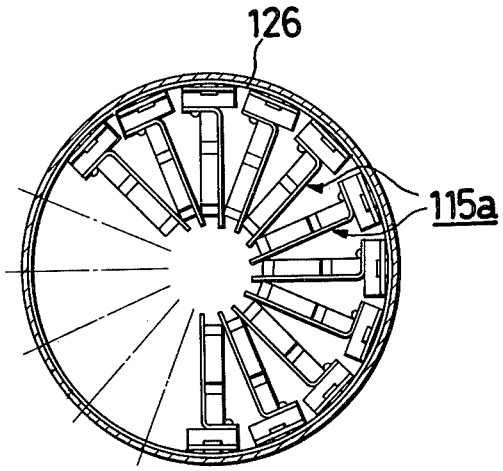

Turning now FIGS. 10 and 11, there is shown another embodiment of the electrical contact provided with a circular cross section according to present invention. As shown in FIG. 10 schematically illustrating the interrelation among the components substantially constituting the electrical contact, the electrical contact 110 comprises a tubular housing 112, a contact assembly 115, a fixed conductor 114 with a stopper 118 and a movable conductor 116. The housing 112 is of tubular shape, unlike that of the previous example. The contact assembly 115 consists of a plurality of contact subassemblies i.e. contact segments 115*a* each being the same as that of the previous example as best shown in FIGS. 3 and 4. The contact assembly may be identical with that of FIG. 8 if the supporting members 26 are made of flexible material so as to be adapted in shape to the circular inner wall of the tubular housing 112. Of course, it is possible to assemble such a contact assembly by using a ring shaped supporting member so shaped as to fit on the inner wall of the tubular housing 112. FIG. 11 schematically illustrates in a cross sectional form a part of the arrangement of the contact assembly 115 when it is mounted on the inner wall of the tubular housing 112 by means of suitable means such as, for example, a bolt-nut combination, adhesives or the like. As seen from the figure, the respective contact sub-assemblies 115*a* are equiangularly disposed along the inner surface of the tubular housing 112 through the supporting member 126. In the instant example, the stopper 118 is shaped as a bobbin, i.e. it is a small cylindrical piece preferably of metal with a flange at both ends. A groove formed between the flanges at respective ends receives the ends of the L-shaped supporting members of the contact sub-assemblies 115*a* disposed around the stopper 118 for properly positioning the contact subassemblies 115*a*. The stopper 118 is fixed at one end of the rod like fixed conductor 114 by means of, for example, a bolt 118'*c*. The groove formed between the flanges 118*a* and 118*b* receives a part of the lower ends of the L-shaped supporting members of the contact sub-assemblies 115*a* disposed around the stopper 118 in order to position the contact assembly 115 in place. The movable conductor 116 of a rod shape is slidably placed between the contacts of the contact sub-assemblies 115*a* for effecting the on-and-off operations of the electrical contact, as in the previous example.

Figure 12:
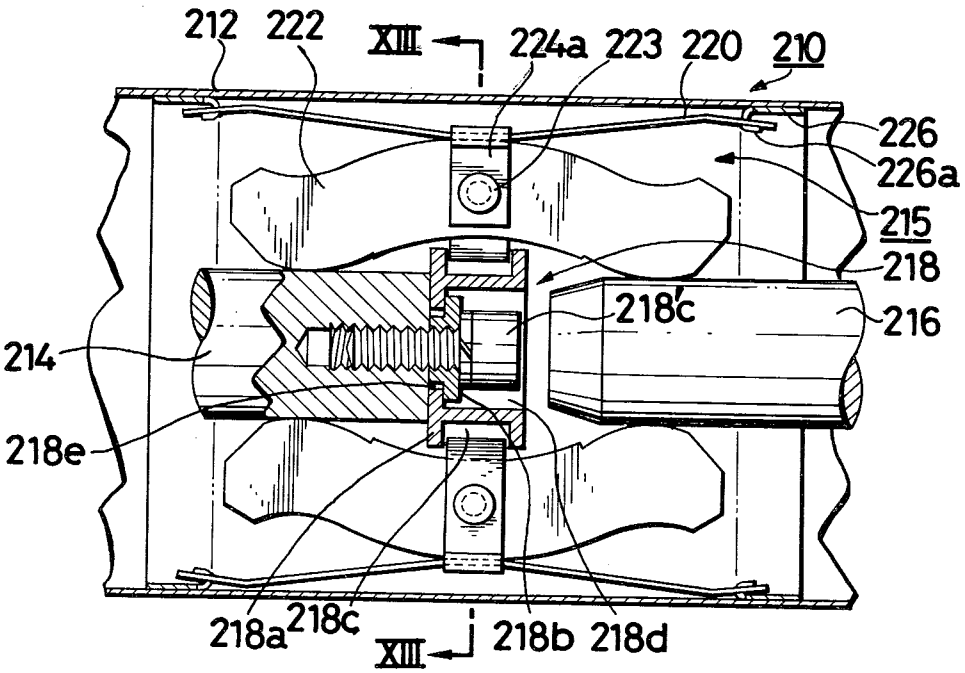
Figure 13:
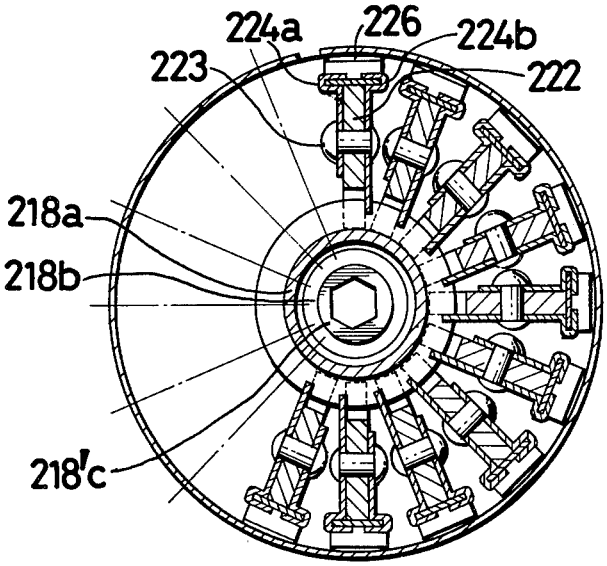

FIGS. 12 and 13 illustrate yet another example of the electrical contact of the present invention. In the figures, reference numeral 222 designates contacts of the contact sub-assemblies 215*a* constituting a contact assembly 215. The contact sub-assemblies 214*a* each has the same construction as that of the previous examples. That is, the contact 222 is fixedly or rotatably mounted at its center by means of a pin 223 to one of two legs of the L-shaped member 224 whose other leg is fixed at the middle portion of the plate spring 220. Each plate spring 222 is flexibly connected at both ends to the supporting members 226. As the supporting member, one such a member as is analogous to the cross section of the conduction is preferable in use. In other words, a circular or ring-shaped supporting member is used for the conductor with circular cross section as in the case of FIG. 12. The loose connection of the plate spring 222 with the supporting member 226 which is preferable is made, for example, by inserting the projections 226*a* into the holes of the plate spring 220.

A fixed conductor designated by 214 is provided at one end with a stopper 218. The stopper 218 is comprised of a cup-shaped stopper body 218*a* with a bore 218*d* communicating with a hole 218*e* and with a groove 218*c* therearound, a washer 218*b* and a bolt 218'*c*. As seen from the figure, the stopper body 218*a* is fixed to the one end of the fixed conductor 214 by means of a bolt 218'*c* through the washer 218*b*. When the electrical contact 210 is assembled, the top end of the L-shaped member 224 is placed in the groove 218*c* in such a way that it is movable up and down therein. As shown in the figure, a gap is formed between the outer diameter of the projection of the washer 218*b* and the diameter of the hole 218*e*, and its length is larger than or equal to the thickness of the stopper body 218*a*. The gap is provided for permitting the stopper body 218*a* to move in the radial direction. In the figure, the reference numerals 216 and 212 designate a movable conductor and a housing, respectively.

As in the previous example, the contact assembly 215 is stably related to the fixed conductor 214 because the supporting member 226 is partly placed in the groove 218*c*.

When the movable contact 216 is moved for an on or off operation, the contacts 222 cause the corresponding plate springs to deform in the radial direction thereby permitting the movable contact to freely pass therethrough. In any case, the radial directional movement of the supporting member 226 in the groove 218*c* ensures the mechanical and electrical contacts between the fixed conductor and the movable conductor and permit a smooth and stable movement of the movable conductor for the turning-on and turning-off operation of the electrical contact. If the fixed conductor 214 is not axially coincident with the movable conductor 216, the contact 222 will meet an excessive displacement when the movable contact 216 is moved for the turning-on and turning-off operation. Accordingly, the force is transmitted through the supporting member 226 to the stopper body 218*a*, and if the transmitted force exceeds the friction force fixing the stopper body 218*a*, it causes the stopper body to move along the gap 218*e* thereby permitting the contacts to displace in accordance with the movement of the movable contact 216. Therefore, even if the axis of the fixed conductor is not coincidence with that of the movable conductor, the movable conductor is smoothly movable to perform the on-off operation under a uniform and stable contact pressure.

The electrical contact heretofore described provides a smooth operation of respective contacts due to an appropriate deformation of the plate springs when the movable conductor is moved for a switching operation. Further, the plate spring, the supporting member and the contacts may be assembled into a single unit, i.e. the contact sub-assembly, and thus the assembling of the electrical contact is greatly simplified.

The force for holding the respective contacts in the radial direction, i.e. the fixing moment, depends largely on the connections of the projection with the holes at opposite ends of the plate spring, even if the connection between the contact and the supporting member through the pin, and the connection between the supporting member and the plate spring are perfectly made. For such reason, the upstanding of the contact member is unstable. Further, the contact member has a thickness much smaller in size than the length extending in the radial direction and hence the contact member tends to incline slightly from the radial direction.

With such instability of the contact members, the individual contact members take directions at random. Therefore, the contact area of the contact member with the fixed and movable conductors is made small, resulting in poor electrical contact.

The following example is directed to overcome such disadvantages of the previous examples.

Figure 14:
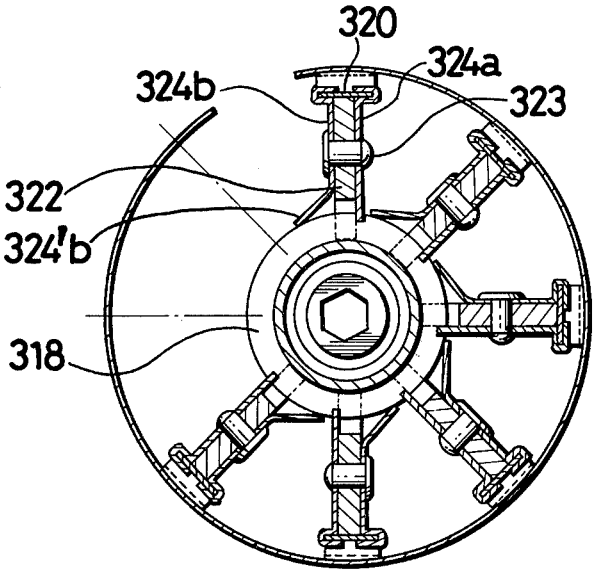

FIG. 14 illustrates in cross sectional form a major portion of the instant example. In the figure, the contact member 322 provided at one end with plate spring 320 is firmly held between a pair of supporting members 324*a* and 324*b* by means of a pin 323. One of the supporting members, designated by reference numeral

324*a*, extends beyond the bottom end of the contact member 322 into the groove of the stopper 318. The other supporting member 324*b* is bent to form a bent portion 324'*b*. The top end of the bent portion is substantially in contact with the extending supporting member 324*a* of the adjacent contact sub-assembly substantially in a disposition normal one to another. As seen from the figure, a plurality of contact members 322 are radially disposed equiangularly in the housing in such a manner that the one ends of the contact members are fixed on the inner wall of the housing while the other ends are disposed substantially in contact with adjacent ones. With such arrangement, the individual contact members interfere with each other to prevent them from inclining.

While the invention has been described with reference to details of the illustrated embodiments, it should be understood that such details do not limit the scope of the invention as defined in the following claims.

What is claimed is:

1. An electrical contact arrangement comprising fixed and movable conductors, a housing, a plurality of contact elements, a leaf spring for each contact element secured to said housing means mounting said contact elements as a single unit in said housing, including an L-shaped supporting member for each contact element and including two legs, means fixing each said leaf spring on one of the legs of the respective said L-shaped supporting member and a pin pivotably coupling the respective said contact element with the second leg, and means supporting the L-shaped supporting members to provide an arrangement of contacts spaced at fixed intervals and including a member having a cross section with a groove mounted at one end of said fixed conductor, said supporting members being received in the groove such that said movable conductor is movable to be in contact with or away from one of the ends of the contact elements for turning the electrical contact arrangement on or off.

2. An electrical contact arrangement according to claim 1, in which the supporting means comprises a rectangular plate having a plurality of projections at one of the longitudinal sides for electrical contact with a conductor of rectangular cross section.

3. An electrical contact arrangement according to claim 1, in which the supporting means is shiftable in the radial direction.

4. An electrical contact arrangement according to claim 1, in which the mounting means includes a third leg, each contact element being sandwiched between the second and third legs, one leg extending beyond said contact element and partially into said groove, the other leg being bent to face said one leg of the adjacent contact element to contact the same if the contact element becomes inclined.

5. An electrical contact arrangement according to claim 1, in which the supporting means has a ring-shape for an electrical conductor of circular cross-section.

6. An electrical contact arrangement according to claim 1, in which the supporting means comprises a pair of parallel plates and spacers maintaining said plates in spaced relation.

7. An electrical contact arrangement according to claim 1, comprising means loosely connecting the opposite ends of each plate spring to said housing.

* * * * *